US007150308B2

(12) United States Patent
Hirai et al.

(10) Patent No.: US 7,150,308 B2
(45) Date of Patent: Dec. 19, 2006

(54) METHOD AND APPARATUS FOR MANUFACTURING METALLIC PARTS BY DIE CASTING

(75) Inventors: Kinji Hirai, Kanagawa (JP); Hisayuki Fukada, Suntogun (JP); Yuuji Osada, Kanagawa (JP)

(73) Assignee: Takata Corporation, Tokyo (JP)

( * ) Notice: Subject to any disclaimer, the term of this patent is extended or adjusted under 35 U.S.C. 154(b) by 0 days.

(21) Appl. No.: 10/930,855

(22) Filed: Sep. 1, 2004

(65) Prior Publication Data

US 2005/0022958 A1 Feb. 3, 2005

Related U.S. Application Data

(62) Division of application No. 10/440,409, filed on May 19, 2003, now Pat. No. 6,945,310.

(51) Int. Cl.

| | |
|---|---|
| ***B22D 17/04*** | (2006.01) |
| ***B22D 17/12*** | (2006.01) |
| ***B22D 17/30*** | (2006.01) |
| ***B22D 39/00*** | (2006.01) |

(52) U.S. Cl. ..... 164/113; 164/133; 164/312; 164/316; 164/337

(58) Field of Classification Search ..... 164/316, 164/317, 318, 335, 336, 337, 312, 113, 133
See application file for complete search history.

(56) References Cited

U.S. PATENT DOCUMENTS

| | | | | |
|---|---|---|---|---|
| 2,386,966 | A | | 10/1945 | MacMillin |
| 2,505,540 | A | | 4/1950 | Goldhard |
| 2,529,146 | A | | 11/1950 | Feitl |
| 2,660,769 | A | | 12/1953 | Bennett |
| 2,785,448 | A | | 3/1957 | Hodler |
| 2,938,250 | A | * | 5/1960 | Larsh et al. ..... 164/62 |
| 3,048,892 | A | | 8/1962 | Davis, Jr. et al. |
| 3,056,178 | A | | 10/1962 | Jagielski |
| 3,106,002 | A | | 10/1963 | Bauer |
| 3,123,875 | A | | 3/1964 | Madwed |
| 3,172,174 | A | | 3/1965 | Johnson |
| 3,189,945 | A | | 6/1965 | Strauss |
| 3,201,836 | A | | 8/1965 | Nyselius et al. |
| 3,254,377 | A | | 6/1966 | Morton |
| 3,268,960 | A | | 8/1966 | Morton |
| 3,270,378 | A | | 9/1966 | Madwed |
| 3,270,383 | A | | 9/1966 | Hall et al. |
| 3,286,960 | A | | 11/1966 | Douglas et al. |

(Continued)

FOREIGN PATENT DOCUMENTS

| | | |
|---|---|---|
| CH | 285535 | 9/1952 |

(Continued)

OTHER PUBLICATIONS

Mehrabian et al., "Casting in the Liquid-Solid Region," *New Trends in Materials Processing*, papers presented at a seminar of American Society for Metals, Oct. 19 and 20, 1974, ASM, Metals Park, OH, pp. 98-127.

(Continued)

*Primary Examiner*—Kevin P. Kerns
(74) *Attorney, Agent, or Firm*—Foley & Lardner LLP

(57) ABSTRACT

An injection molding apparatus includes a melt furnace and a metal supply system located in the melt furnace. The metal supply system includes a pump. The injection molding apparatus also includes a first metal inlet from the melt furnace to the metal supply system and a vertical injection mechanism adapted to inject liquid metal into a die system. The injection molding apparatus also includes a second metal inlet from the metal supply system to the vertical injection mechanism.

2 Claims, 10 Drawing Sheets

U.S. PATENT DOCUMENTS 3,319,702 A 5/1967 Hartwig et al.
3,344,848 A 10/1967 Hall et al.
3,447,593 A 6/1969 Nyselius et al.
3,474,854 A 10/1969 Mace
3,491,827 A 1/1970 Mace
3,529,814 A 9/1970 Werner
3,550,207 A 12/1970 Strauss
3,693,702 A 9/1972 Piekenbrink et al.
3,773,873 A 11/1973 Spaak et al.
3,810,505 A 5/1974 Cross
3,814,170 A 6/1974 Kahn
3,874,207 A 4/1975 Lemelson
3,893,792 A 7/1975 Laczko
3,902,544 A 9/1975 Flemings et al.
3,926,247 A * 12/1975 Geiger et al. ..... 164/263
3,936,298 A 2/1976 Mehrabian et al.
3,976,118 A 8/1976 Kahn
4,049,040 A 9/1977 Lynch
4,088,178 A 5/1978 Ueno et al.
4,168,789 A 9/1979 Deshais et al.
4,212,625 A 7/1980 Shutt
4,248,289 A 2/1981 Perrella et al.
4,287,935 A * 9/1981 Ueno et al. ..... 164/314
4,330,026 A 5/1982 Fink
4,347,889 A 9/1982 Komatsu et al.
4,387,834 A 6/1983 Bishop
4,408,651 A 10/1983 Smedley et al.
4,434,839 A 3/1984 Vogel
4,436,140 A 3/1984 Ebisawa et al.
4,473,103 A 9/1984 Kenney et al.
4,476,912 A 10/1984 Harvill
4,510,987 A 4/1985 Collot
4,534,403 A 8/1985 Harvill
4,537,242 A 8/1985 Pryor et al.
4,559,991 A 12/1985 Motomura et al.
4,586,560 A 5/1986 Ikeya et al.
4,635,706 A 1/1987 Behrens
4,687,042 A 8/1987 Young
4,694,881 A 9/1987 Busk
4,694,882 A 9/1987 Busk
4,730,658 A 3/1988 Nakano
4,771,818 A 9/1988 Kenney
4,828,460 A 5/1989 Saito et al.
4,834,166 A 5/1989 Nakano
4,884,621 A 12/1989 Ban et al.
4,898,714 A 2/1990 Urban et al.
4,952,364 A 8/1990 Matsuda et al.
4,997,027 A 3/1991 Akimoto
5,040,589 A 8/1991 Bradley et al.
5,109,914 A 5/1992 Kidd et al.
5,143,141 A 9/1992 Frulla
5,144,998 A 9/1992 Hirai et al.
5,161,598 A 11/1992 Iwamoto et al.
5,181,551 A 1/1993 Kidd et al.
5,186,236 A 2/1993 Gabathuler et al.
5,191,929 A 3/1993 Kubota et al.
5,205,338 A 4/1993 Shimmell
5,244,033 A 9/1993 Ueno
5,375,645 A 12/1994 Brueker et al.
5,380,187 A 1/1995 Fujikawa
5,388,633 A 2/1995 Mercer, II et al.
5,394,931 A 3/1995 Shiina et al.
5,413,644 A 5/1995 Marder et al.
5,454,423 A * 10/1995 Tsuchida et al. ..... 164/337
5,501,266 A 3/1996 Wang et al.
5,531,261 A 7/1996 Yoshida et al.
5,533,562 A 7/1996 Moschini et al.
5,571,346 A 11/1996 Bergsma
5,575,325 A 11/1996 Sugiura et al.
5,577,546 A 11/1996 Kjar et al.
5,601,136 A 2/1997 Shimmell
5,622,216 A 4/1997 Brown
5,623,984 A 4/1997 Nozaki et al.
5,630,463 A 5/1997 Shimmell
5,630,466 A 5/1997 Garat et al.
5,638,889 A 6/1997 Sugiura et al.
5,657,812 A 8/1997 Walter et al.
5,662,159 A 9/1997 Iwamoto et al.
5,664,618 A 9/1997 Kai et al.
5,665,302 A 9/1997 Benni et al.
5,680,894 A 10/1997 Kilbert
5,685,357 A 11/1997 Kato et al.
5,697,422 A 12/1997 Righi et al.
5,697,425 A 12/1997 Nanba et al.
5,701,942 A 12/1997 Adachi et al.
5,704,411 A 1/1998 Suzuki et al.
5,716,467 A 2/1998 Marder et al.
5,730,198 A 3/1998 Sircar
5,730,202 A 3/1998 Shimmell
5,735,333 A 4/1998 Nagawa
5,770,245 A 6/1998 Takizawa et al.
5,836,372 A 11/1998 Kono
5,839,497 A 11/1998 Fujino et al.
5,861,182 A 1/1999 Takizawa et al.
5,913,353 A * 6/1999 Riley et al. ..... 164/113
5,983,976 A 11/1999 Kono
6,065,526 A 5/2000 Kono
6,135,196 A 10/2000 Kono
6,241,001 B1 6/2001 Kono
6,273,308 B1 8/2001 Choshi
6,276,434 B1 8/2001 Kono
6,283,197 B1 9/2001 Kono
6,284,167 B1 9/2001 Fujikawa
6,334,975 B1 1/2002 Yokote et al.
6,666,258 B1 12/2003 Kono
6,945,310 B1 * 9/2005 Hirai et al. ..... 164/312
2004/0231819 A1 11/2004 Hirai et al.
2004/0231821 A1 11/2004 Hirai et al.

FOREIGN PATENT DOCUMENTS

DE 196 11 419 9/1996
EP 0 476 843 3/1992
EP 0 632 244 A2 1/1995
EP 0 691 166 A1 1/1996
EP 0 761 344 3/1997
EP 1 038 614 A1 9/2000
FR 1.447.606 6/1996
JP 59-152826 8/1984
JP 1-166874 6/1989
JP 1-178345 7/1989
JP 1-192447 8/1989
JP 2-274360 1/1990
JP 2-202420 8/1990
JP 3-258448 * 11/1991
JP 5-8012 1/1993
JP 5-8016 1/1993
JP 5-8017 1/1993
JP 5-285626 11/1993
JP 5-285627 11/1993
JP 6-306507 11/1994
JP 7-51827 2/1995
JP 8-72110 3/1996
JP 8-174172 7/1996
JP 8-252661 10/1996
JP 9-103859 4/1997
JP 9-155524 6/1997
JP 9-155526 6/1997
JP 9-155527 6/1997
JP 9-295122 11/1997
JP 2001-150124 A 6/2001
JP 2002-137052 A 5/2002
JP 2002-273564 A 9/2002
WO WO 92/13662 8/1992

| | | |
|---|---|---|
| WO | WO 97/21509 | 6/1997 |
| WO | WO 97/45218 | 12/1997 |
| WO | WO 99/28065 | 6/1999 |
| WO | WO 99/50007 | 10/1999 |

OTHER PUBLICATIONS

Flemings et al., "Rheocasting," *Challenges and Opportunities in Materials Science and Engineering*(Anniversary Volume), vol. 25 (1976), Elsevier Sequoia S.A., Lausanne, pp. 103-117.

Flemings et al., "Rheocasting," *McGraw-Hill Yearbook of Science and Technology, 1977*, McGraw-Hill Book Company, NY, pp. 49-58.

Laxmanan et al., "Deformation of Semi-Solid Sn-15 Pct. Pb Alloy," *Metallurgical Transactions A*, vol. 11A: No. 12, Dec. 1980, pp. 1927-1937.

Matsumiya et al., "Modeling of Continuous Strip Production by Rheocasting," *Metallurgical Transactions B*, vol. 12B, No. 1, Mar. 1981, pp. 17-31.

Suery et al., "Effect of Strain Rate on Deformation Behavior of Semi-Solid Dendritic Alloys," *Metallurgical Transactions A*, vol. 13A, No. 10: Oct. 1982, pp. 1809-1819.

Worthy, Ward, "Injection Molding of Magnesium Alloys," *Chemical & Engineering News*, vol. 66, No. 23, Jun. 6, 1988, pp. 29-30.

Tissier et al., "Magnesium rheocasting: a study of processing-microstructure interactions," *Journal of Materials Science*, vol. 25 (1990). Chapman and Hall Ltd., pp. 1184-1196.

Carnahan et al., "New Manufacturing Process for Metal Matrix Composite Synthesis," *Fabrication of Particulates Reinforced Metal Composites*, Proceedings of an International Conference, Montreal, Quebec, Sep. 17-29, 1990, ASM International, Metals Park, Ohio, pp. 101-105.

Flemings, "Behavior of Metal Alloys in the Semisolid State," *Metallurgical Transactions B*, vol. 22B, No. 3, Jun. 1991, pp. 269-293.

Pasternak et al., "Semi-Solid Production Processing of Magnesium Alloys by Thixomolding," Proceedings of the Second International Conference on the Semi-Solid Processing of Alloys and Composites, MIT, Cambridge, MA, Jun. 10-12, 1992, TMS, Warrendale, PA, pp. 159-169.

Brown et al., "Net Shape Forming via Semi-Solid Processing," *Advanced Materials & Processes*, vol. 143, No. 1, Jan. 1993, ASM International, Metals Park, OH, pp. 36-40.

Carnanan et al., "Advances in Thixomolding," 52nd Annual World Magnesium Conference, Berlin, Germany, May 17-19, 1994.

Fujikawa, Misao, Conference Material, Sodick Plastech Co., Ltd., Jul. 1995, pp. 1-14.

Staff Report, "Semi-Solid Metalcasting Gains Acceptance, Applications," *Foundry Management & Technology*, Nov. 1995, Japan, pp. 23-26.

Tuparl Injection Molding Machine Advertisement, Sodick Plastech Co., Ltd., May 1997.

Kalpakjian, Serope, *Manufacturing Processes for Engineering Materials*, 3rd edition, Addison Wesley Longman, Inc., Menlo Park, CA, 1997, pp. 261-263, 265-266.

"Plastic Processing Technology Book," Published in Japan (ISBN 4-526-00035-3), pp. 134-136.

Material Science & Technology Textbook, Fig. 1-67(b), p. 52.

* cited by examiner

METHOD AND APPARATUS FOR MANUFACTURING METALLIC PARTS BY DIE CASTING

This is a divisional of U.S. application Ser. No. 10/440,409, now U.S. Pat. No. 6,945,310.

FIELD OF THE INVENTION

The invention relates to a method and apparatus for manufacturing metallic parts, more particularly to a method and apparatus for manufacturing metallic parts by a process involving injection of liquid metal into a mold, including die casting methods.

BACKGROUND OF THE INVENTION

Conventional die casting apparatus are classified into cold chamber and hot chamber. In cold chamber die casting apparatus, molten metal is poured into a sleeve which is secured on a die plate and connected to an inlet opening to the mold cavity. Molten metal is injected by a plunger into the die. The molten metal in the sleeve is easily cooled down when it spreads at the bottom of the sleeve as the plunger moves forward slowly to discharge air or gas. Cooled molten metal in the sleeve forms a chilled fraction and semi-solid or solid particles. The chilled fraction and particles are injected into the molding die causing the physical properties of molded parts to be deteriorated.

Cooled molten metal increases the viscosity of the molten metal and makes it difficult to fill the mold cavity. Further, it causes blemishes on surface of a molded part. This is a serious problem particularly for magnesium alloys for which the latent heat of solidification is small (smaller than aluminum, lead and zinc). Because of the small latent heat of solidification, magnesium solidifies quickly when it comes in contact with materials having a lower temperature.

Hot sleeves have been used, but the heated sleeve is not as hot as liquidus temperature of the metal because the sleeve is connected to a molding die whose temperature has to be below the solidus temperature of the metal. The molding die temperature must be sufficiently below the solidus temperature of the molten metal to produce an adequate solidification rate. That is, a solidification rate which reflects the required time for an operation cycle. Molten metal poured into the sleeve has a substantially higher temperature than the liquidus temperature of the metal to counter the cooling in the sleeve. This is a disadvantage in energy cost for heating.

The cold chamber apparatus forms a thick round plate as a part of the casting, often called a biscuit, in the sleeve between a plunger head and an inlet of a die. After the casting is pulled away from the molding dies when the dies are opened, the biscuit is cut away from the casting and recycled. However, sometimes the biscuit is larger than the product. This is a disadvantageous use of metal which has a substantial recycling cost.

In hot chamber die casting apparatus, an injection mechanism is submerged in molten metal in a furnace. The temperature of the molten metal to be injected is maintained above its liquidus. The injection mechanism has a shot cylinder with a plunger, gooseneck chamber and a nozzle at the end of thereof. The molten metal is injected through a gooseneck-type passage and through a nozzle into the die cavity without forming a biscuit. This is an advantage of hot chamber die casting apparatus.

Another advantage of a hot chamber apparatus over a cold chamber apparatus is the time for an operation cycle. As mentioned above, in cold chamber apparatus, the casting is formed by injecting molten metal into a mold cavity between closed dies and cooling to until the casting is solid. The dies are separated and the molded part is pulled away, lubricant is sprayed onto the opened dies, and the dies are closed again. Then, the dies are ready to start the next operation cycle. The molten metal is poured into the injection sleeve when the molding dies are closed, i.e., when the dies are ready to start the next operation cycle, so that the molten metal does not spill out from the inlet opening of the die because the injection sleeve directly communicates with a die.

On the other hand, hot chamber die casting apparatus fill molten metal in the gooseneck and a shot cylinder system by returning an injection plunger to its fill up position. Molten metal is supplied through an opening or fill port on a shot cylinder. While cooling the injected molten metal in the dies, the nozzle is positioned by inclining the gooseneck chamber. The molten metal in the nozzle gooseneck system tends to flow back into the furnace through the fill port on the shot sleeve, reaching a hydrostatic level when the dies are opened. By simultaneously filling molten metal into the gooseneck and a shot cylinder system and cooling injected metal in the closed dies, time for an operation cycle of the hot chamber apparatus is shortened compared with the cold chamber die casting apparatus.

However, solidification of the molten metal in the nozzle section of the gooseneck and dripping of molten metal from the nozzle and the cast sprue are problems for hot chamber die casting apparatus. It is known that in hot chamber die casting apparatus a vacuum is created in the injection mechanism when the plunger is withdrawn. However, the vacuum is instantaneously destroyed once the plunger passes the opening or fill port on the shot cylinder supplying molten metal from the furnace because the furnace is at atmospheric pressure. Thus, the molten metal is sucked into the shot cylinder, and the gooseneck and the nozzle are completely filled at the time that the casting is solidified and the dies are separated.

There is molten metal in the nozzle for most of the time that the casting is cooling. When the cooling at the tip of the nozzle is properly controlled, it is understood in the industry that the metal in the nozzle tip becomes semi-solid. The formed semi-solid metal works as a plug which prevents molten metal from dripping out of the nozzle when the dies are separated. If the cooling is insufficient, the metal in the tip of the nozzle and the cast sprue is still liquid when the dies are separated and dripping occurs. On the other hand, when too much cooling is applied, the metal in the nozzle tip solidifies and freezes together with the cast sprue. The casting will stick in the stationary die after the dies open.

U.S. Pat. Nos. 3,123,875, 3,172,174, 3,270,378, 3,474,854 and 3,491,827 propose creating a vacuum in the gooseneck by return or reverse stroke of the plunger to draw back molten metal from the nozzle and extreme tip of the sprue. These patents disclose mechanisms attached to the shot cylinder and a plunger system so that the created vacuum is kept intact until after the dies have been separated and the solidified casting has been withdrawn from the sprue opening of the stationary die.

Problems in the hot chamber die casting apparatus are caused because a heavy injection mechanism is submerged in the molten metal in the furnace. The injection mechanism with a gooseneck chamber and a shot cylinder system is difficult to clean up. It is also difficult to replace worn plunger rings and sleeves. A worn plunger ring and sleeve decreases injection pressure due to leakage and makes shot volume inconsistent in filling the mold cavity. The inconsistent shot volume produces inconsistent molded parts.

Die casting apparatus are also classified according to the arrangement of the injection system, that is, horizontal and vertical. In a horizontal die casting apparatus, an injection system is horizontally arranged for horizontally injecting molten metal into molding dies. A vertical die casting apparatus has a vertically arranged injection system for vertical injection of molten metal.

Conventional vertical die casting apparatus typically are vertically arranged cold chamber apparatus that have the same advantages and disadvantages of the cold chamber apparatus described above. However, a feature of the vertical die casting apparatus is that the inlet opening for molten metal can be on top of the vertical injection chamber. This arrangement is not applicable to the horizontally arranged apparatus. In U.S. Pat. Nos. 4,088,178 and 4,287,935, Ube discloses machines in which a vertical casting sleeve is pivotally mounted to a base and slants from perpendicular position to accept molten metal. In place of supplying molten metal to the casting sleeve, Nissan Motors discloses in U.S. Pat. No. 4,347,889 a vertical die casting machine in which a vertical casting sleeve moves downward and a solid metal block is inserted. The inserted metal block is melted in the sleeve by an high frequency induction coil. The problem with these apparatus is the complexity of their structure.

SUMMARY OF THE INVENTION

One embodiment of the invention relates to an injection molding apparatus comprising a melt furnace, a metal supply system located in the melt furnace, the metal supply system comprising a pump, a first metal inlet from the melt furnace to the metal supply system, a vertical injection mechanism adapted to inject liquid metal into a mold, and a second metal inlet from the metal supply system to the vertical injection mechanism.

Another embodiment of the invention relates to an injection molding method comprising providing solid metal into a melt furnace, melting the solid metal into a liquid state in the melt furnace, providing the liquid metal from the melt furnace through a first metal inlet into a metal supply system located in the melt furnace, pumping the liquid metal from the metal supply system through a second metal inlet into a vertical injection mechanism, and injecting the liquid metal from the vertical injection mechanism into a mold located above the vertical injection mechanism.

Another embodiment of the invention relates to an injection molding apparatus comprising a melt furnace, a metal supply system comprising a pump and a conduit, a first metal inlet from the melt furnace to the metal supply system, an injection mechanism adapted to inject liquid metal into a mold, a second metal inlet from the conduit of the metal supply system to the injection mechanism, a three way valve located across the conduit, and a valve actuator operatively connected to the valve. The valve actuator is adapted to vertically move the valve to a first vertical position relative to the conduit allow liquid metal to flow from the melt furnace into the conduit, to a second vertical position relative to the conduit to allow liquid metal to flow from the conduit toward the second metal inlet, and to a third position to allow liquid metal to flow from the injection mechanism to a drain.

Another embodiment of the invention relates to an injection molding apparatus comprising a melt furnace, a metal supply system comprising a gear pump and a conduit located in the melt furnace, a first metal inlet from the melt furnace to the gear pump, an injection mechanism adapted to inject liquid metal into a die system, and a second metal inlet from the conduit of the metal supply system to the injection mechanism.

Another embodiment of the invention relates to a method of injecting liquid metal into a mold comprising providing liquid metal into a vertical injection chamber containing an injection plunger and an injection nozzle, advancing the injection plunger in the injection chamber to drive off air in the injection chamber at a first speed, injecting liquid metal into a mold cavity by advancing the injection plunger in the injection barrel at a second speed greater than the first speed, and retracting the injection plunger to suck back molten or semi-solid metal from at least one of a sprue of the mold or the injection nozzle tip into the injection chamber.

Another embodiment of the invention relates to an injection molding system, comprising, an injection chamber containing an injection nozzle, and a mold system containing a first die, a second die and a sprue bushing in the first die. The injection nozzle and the sprue bushing are shaped such that when the nozzle contacts the sprue bushing, the contact area between the nozzle and the sprue bushing is substantially one dimensional.

Another embodiment of the invention relates to a vertical mold system for use with an injection molding apparatus comprising an injection barrel terminating in an injection nozzle, the mold system comprising a lower stationary die, an upper movable die, a mold cavity located in at least one of the lower and the upper die, and a sprue bushing located in the lower die. The mold system further comprises at least one of the following features: (a) an opening in the lower die connected to the sprue bushing, the opening having a diameter that is wider than a diameter of the injection barrel, (b) a shutter plate adapted to cover the injection nozzle when the upper die and the lower die are separated, wherein the shutter plate is located between the upper die and the lower die when the shutter plate covers the injection nozzle, and (c) a shuttle tray adapted to remove a molded part from the mold cavity when the upper die and the lower die are separated, wherein the shuttle tray is located between the upper die and the lower die when the upper and the lower die are separated.

Another embodiment of the invention relates to an injection molding method comprising providing material to be injected into a vertical injection barrel terminating in an injection nozzle, closing a vertical mold system comprising a lower stationary die, an upper movable die, a mold cavity located in at least one of the lower and the upper die, a sprue bushing located in the lower die, and an opening located in the lower die connected to the sprue bushing, raising the vertical injection barrel such that the injection nozzle contacts the sprue bushing and at least a portion of the injection barrel is located in the opening in the lower die, injecting the material from the injection barrel into the mold cavity, raising the upper die to open the vertical mold system, moving a shutter plate between the raised upper die and the lower die to cover the injection nozzle, removing a molded part from the mold cavity, spraying the mold cavity with a lubricant after the steps of moving the shutter plate and removing the molded part, moving the shutter plate away from the injection nozzle and out from between the upper and the lower die, and lowering the vertical injection barrel such that the injection nozzle does not contact the sprue bushing.

DETAILED DESCRIPTION OF THE PREFERRED EMBODIMENTS

Figure 1B:
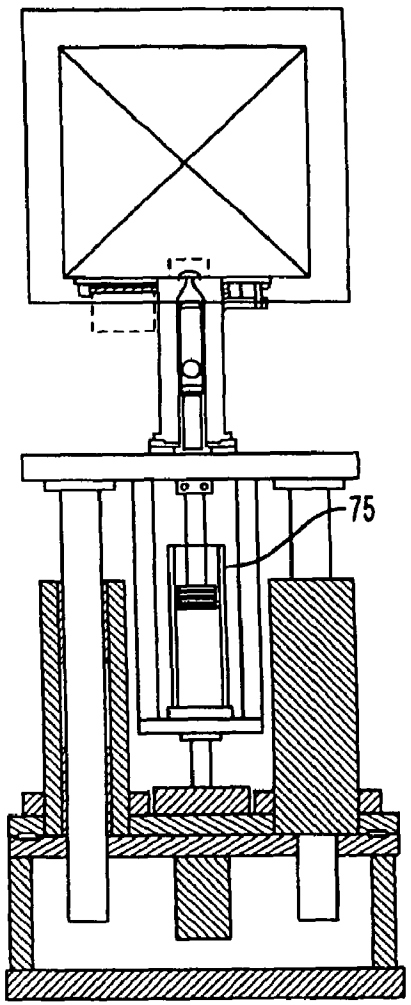
FIG. 1B is a schematic front view of an injection molding apparatus according to one embodiment of the invention.

As illustrated in FIGS. 1A, 1B, 2A and 2B, one embodiment of the present invention is a vertical die casting apparatus with a horizontal die arrangement. The die casting apparatus is comprised of a furnace 1, a casting metal supply system 2, a vertical injection mechanism 3 and a horizontally arranged mold or die system 4.

The furnace has a heating chamber 11 and an opening 12 that provides access for a gas flame or other heat-supplying means. To maintain the casting metal 16 in a liquid state, a melting pot 13 is mounted in the heating chamber 11. The melting pot 13 is preferably separated into two receptacles, A and B, by means of partition 14. The melting pot 13 is covered by an insulated metal plate 55. In addition, it is preferable for metals which are easily oxidized, such as magnesium alloys, to introduce inert gas such as argon or $SF_6$. The receptacle A is for melting metal ingots or pellets, supplied through an opening 17 covered by door 19. Through an opening 15 in the lower part of the partition 14, clean molten (i.e. liquid) metal 16 passes to the receptacle B, where the molten metal 16 is maintained at a temperature preferable for casting of the metal, such as above the liquidus temperature. Alternatively, the partition may comprise a mesh filter which allows liquid but not solid metal to pass through it.

The temperature of the molten metal 16 is measured by a thermocouple. Heat output of the heat-supply means is adjusted according to feedback of the measured temperature. The level of the molten metal 16 in the melting pot 13 is determined by a level sensor 18 and maintained in a certain range by controlling the volume of metal supplied through the opening 17. Preferably, the level of molten metal 16 is controlled by pulling down a-suspended ingot into the melt, by moving a conveyer supplying ingots or pellets over the opening 17 for a predetermined time or by hand feeding solid metal into opening 17, in response to a signal from the level sensor 18.

The casting metal supply system 2 is attached to a plate 20 and comprises a metering sleeve 21, in which a metering plunger 23 is inserted, a three-way valve 22, a conduit 38 and a conduit 24, which corresponds to a gooseneck. The lower part of the system 2 is submerged in the molten metal 16 so as to keep the molten (i.e., liquid) metal 16 in the metal supply system 2 at the same temperature as molten casting metal 16 in the melting pot 13. Therefore, the level of the casting metal 16 in the receptacle B in the melting pot 13 should be well above the full up position of the metering plunger 23 in the plunger sleeve 21.

Functions of the three way valve 22 are schematically shown in FIG. 3. Preferably, the three way valve 22 comprises a tube containing three passages 39A, 39B and 39C that is adapted to move perpendicular to a metal flow direction in the adjacent conduit(s) 24, 38. However, the valve 22 may have any other suitable valve structure and configuration. The first passage 39A is preferably parallel to the metal flow direction in the first 38 and the second 24 conduits to connect parallel portions of the first and the second conduits to each other. The second passage 39B preferably comprises at least one portion that is inclined by 1 to 90 degrees with respect to the metal flow direction in the first conduit 38. For example, passage 39B may be a diagonal passage inclined by 20 to 70 degrees. Passage 39B connects the first metal inlet 40 to the first conduit 38 which is operatively connected to the pump 23. The third passage 39C comprises at least one portion that is inclined by 1 to 90 degrees with respect to the metal flow direction in the second conduit 24. For example, the third passage 39C may be a passage having a horizontal and a vertical portion. Passage 39C connects a drain to the second conduit 24.

Figure 3C:
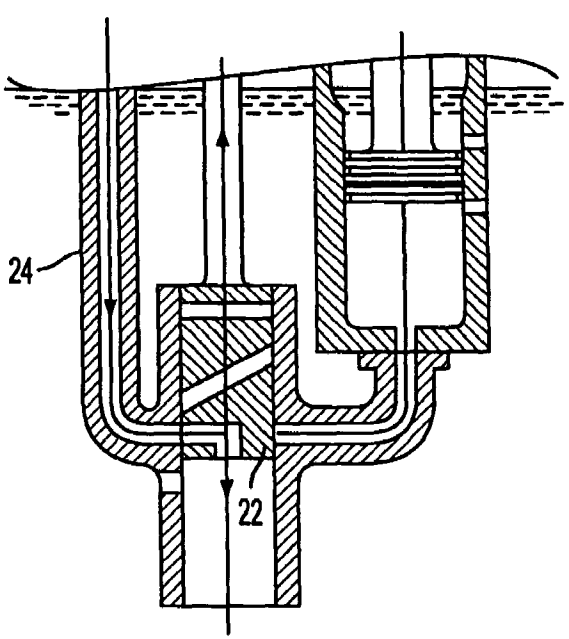
FIGS. 3A–3C are schematic views of a three-way valve according to one embodiment of the invention illustrating A) a first setting, B) a second setting and C) a third setting of the valve.
Figure 3B:
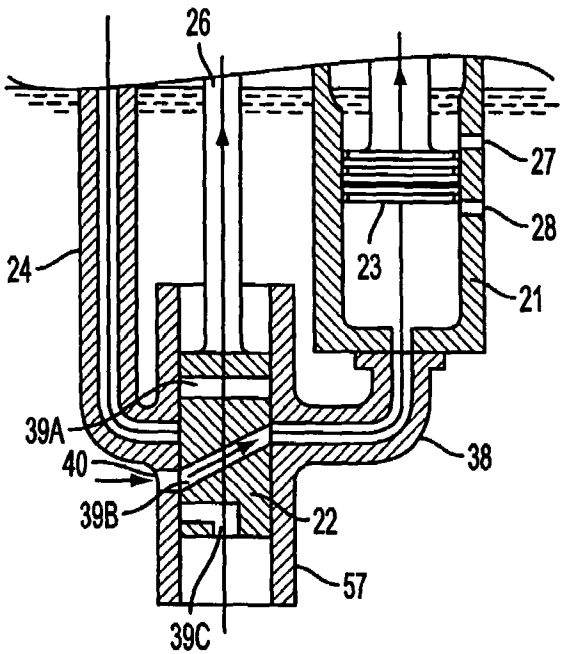
Figure 3A:
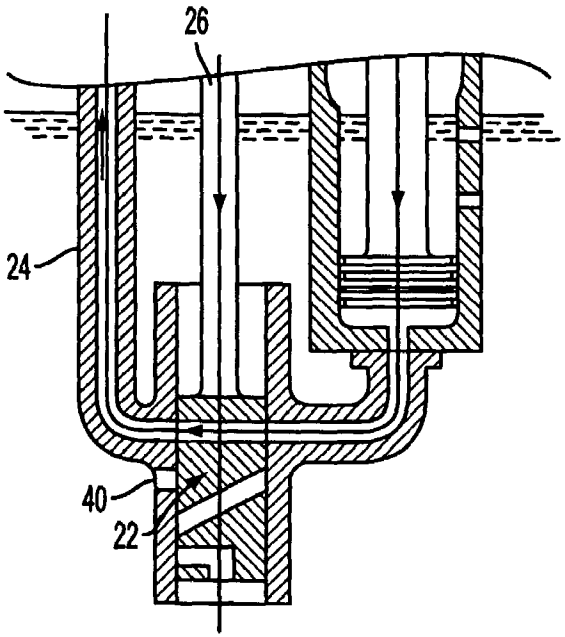

The three-way valve changes passages for the casting metal. Initially, (FIG. 3B) the metering plunger 23 is at the full up position with opening 27 located above the plunger and opening 28 below the plunger. When the metering plunger 23 descends as shown in FIG. 3A, molten metal 16 flows in over the metering plunger through both openings 27, 28. When the metering plunger 23 moves upward, molten metal 16 on top of the metering plunger 23 is lifted and then flows out from both openings, finally leveling with molten metal 16 in the melting pot 13.

Due to the flow from the both openings 27, 28, the metering plunger 23 is heated up to the same temperature as the molten metal 16 in the melting pot 13. Thus, the temperature of the metering plunger 23 does not affect the temperature of molten metal 16 in the metering sleeve 21. Further, heaters are attached around the conduit 24 above the level of the molten metal 16 to keep the metal therein molten at a temperature chosen considering casting performance. Preferable heaters for the conduit 24 are coil heaters or sheathed heaters.

In the first setting of the three-way valve 22, a valve actuator 26 lowers the three-way valve 22 to a first position so that a first passage 39A fluidly connects the plunger sleeve 21 to the injection barrel 31 via a first conduit 38, a second conduit 24 and a connecting port 37 to allow the molten metal to flow from the metering plunger toward an opening 33 in the injection barrel 32. The metering plunger 23 is then lowered to force metal from sleeve 21 through conduit 38, valve 22, conduit 24 and opening 33 into chamber 31. After the metal is provided to chamber 31, the valve actuator 26 is lifted to a second position until the second passage 39B connects an inlet port 40 to the first conduit 38 to allow molten metal to flow from the melting pot 13 through opening 40 into the sleeve 21. When the metering plunger 23 is withdrawn, suction is created, drawing molten metal 16 from the melting pot 13 to the metering sleeve 21.

During normal operation, only the first two passages 39A, 39B are used. However, if it becomes necessary to remove the casting metal supply system 2 to perform maintenance, the three-way valve 22 may be operated in the third position. In this position, the second conduit 24 is connected to a drain 57. In this manner, molten metal 16 in the injection barrel 31 and the second conduit 24 can be emptied into the melting pot 13.

The injection mechanism 3 is attached to a base plate 30 on which the plate 20 is also fixed supporting the casting metal supply system 2. As the injection mechanism 3 and the casting metal supply system 2 are rigidly attached to the same base plate 30, these two components move up and down simultaneously without moving the melt furnace 1. While two plates 20, 30 are illustrated as rigidly attaching components 2 and 3 together, other attaching devices may be used instead. For example, one or more plates, rods or clamps may be used to attach components 2 and 3 to each other. Therefore no bending force is applied to the conduit 24 and material for the metal supply system 2 can be selected from various materials including ceramics suitable for light metal injection, such as magnesium or aluminum injection. The injection mechanism 3 is comprised of an injection barrel 31 with a connection port 37, an injection plunger 32 located in the injection barrel 31 and an injection nozzle 35 on the top of the injection barrel 31. The casting metal 16 is poured into the injection barrel 31 through a metal inlet opening 33 connected to the conduit 24 at the connection port 37. The connection port 37 declines to the conduit 24 so that in an emergency, casting metal 16 in the barrel 31 is drained back to the melting pot 13 through the three-way valve 22. This is illustrated in FIG. 3C.

Figure 4A:
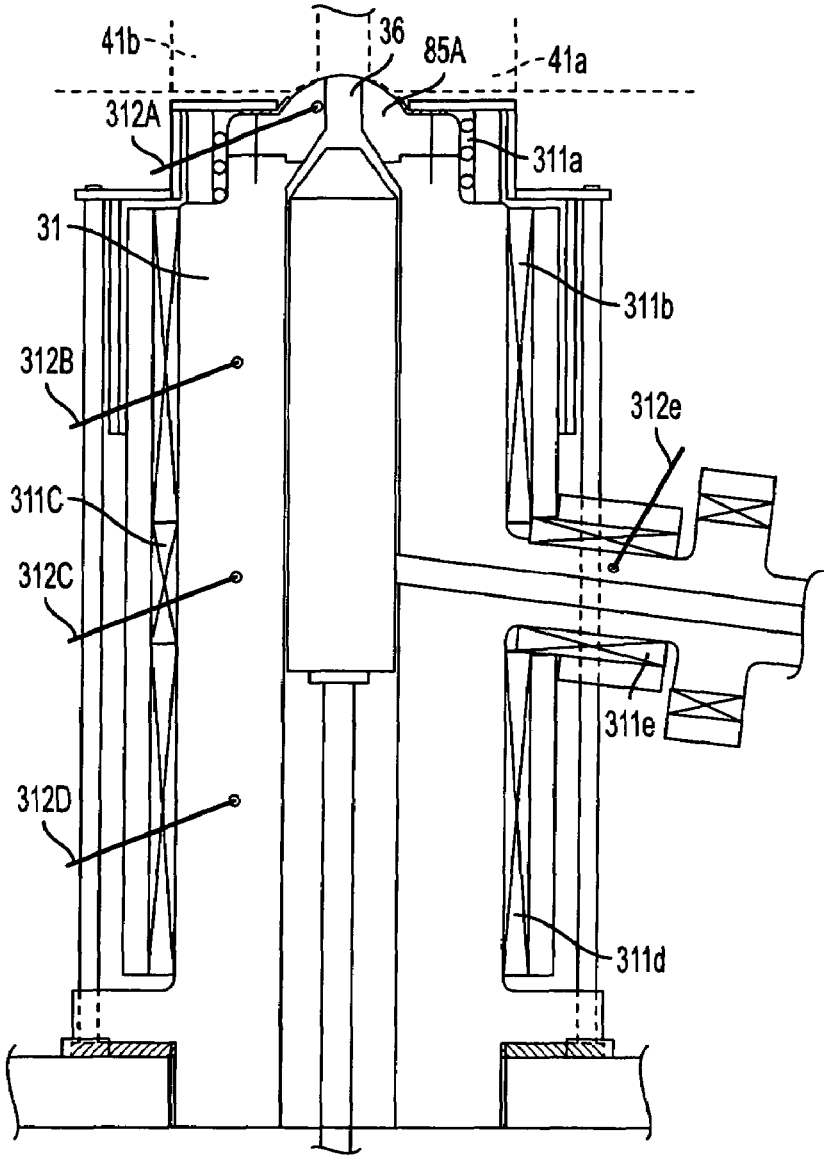
FIG. 4A is a schematic view of a vertical injection barrel and nozzle according to one embodiment of the invention.
Figure 4B:
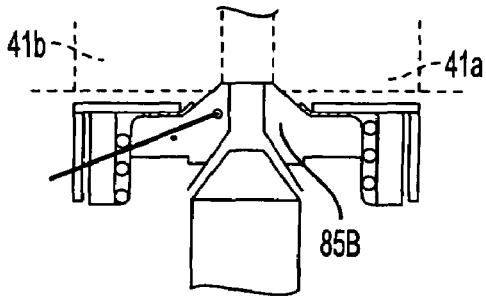
FIG. 4B is a close up view of a nozzle according to a comparative example.

As shown in FIGS. 4A and 4B the injection barrel 31 is heated by heaters 311*a, b, c* and d to maintain the injection barrel 31 above liquidus temperature of the metal to be injected. In addition, a heater 311*e* heats the injection barrel connection port 37. The heaters 311*a, b, c, d* are divided into sections so that each heater may be maintained at a different temperature and the poured casting metal 16 may be maintained at the most preferable temperature for injection. Each heater is independently controlled in response to a signal from a corresponding thermocouple 312*a, b, c* and *d* inserted in wall of the injection barrel 31 and the nozzle 35. The injection barrel connection port heater 311*e* is controlled by thermocouple 312*e*.

The injection mechanism 3 and the injection plunger 32 are preferably actuated by a hydraulic cylinder 74 and a hydraulic piston cylinder 75 respectively. However, any means capable of raising the injection mechanism 3 and the injection plunger 32 may be used. Exemplary devices include, but are not limited to, mechanical, electrical, and pneumatic devices and combinations thereof.

It is preferable to maintain the nozzle temperature above liquidus of the metal. The nozzle 35, heated above the liquidus, is cooled due to heat conduction, especially when the nozzle 35 is docked with the sprue bushing 41, which has the same temperature as the dies 42, 43 of the die system 4. The die temperature is much lower than the solidus temperature of the metal. This is because the casting metal has to solidify in the mold or die cavity 44 quickly for high productivity. Therefore, the nozzle 35 is cooled due to heat conduction from the nozzle 35 to the dies 42, 43 via the sprue bushing 41. The cooling rate of the nozzle 35 corresponds to rate of heat loss transferred from the nozzle 35 to the dies 42, 43. This is determined by heat gradient, area in contact and duration of heat transfer. The temperature of the nozzle 35 is determined as one of casting conditions of the metal while that of the dies 42, 43 are determined mainly by productivity. The primary difference is the gradient of temperature. Therefore, the contacting area between the nozzle 35 and the sprue bushing 41 should be minimized by preferably contacting in line 85A as shown in FIG. 4A instead of contacting in a face 85B as shown in FIG. 4B. In other words, the injection nozzle 35 and the sprue bushing 41 should be shaped such that when the nozzle contacts the sprue bushing, the contact area between the nozzle and the sprue bushing is substantially one dimensional (i.e., a line or a ring having a width of 1 mm or less in a direction of the length of the nozzle). The difference in radius and angle of the nozzle head 35 and the sprue bushing 41 should be not less than 1 mm and 1 degree respectively, and docking time of the two parts should be as short as possible.

Figure 1A:
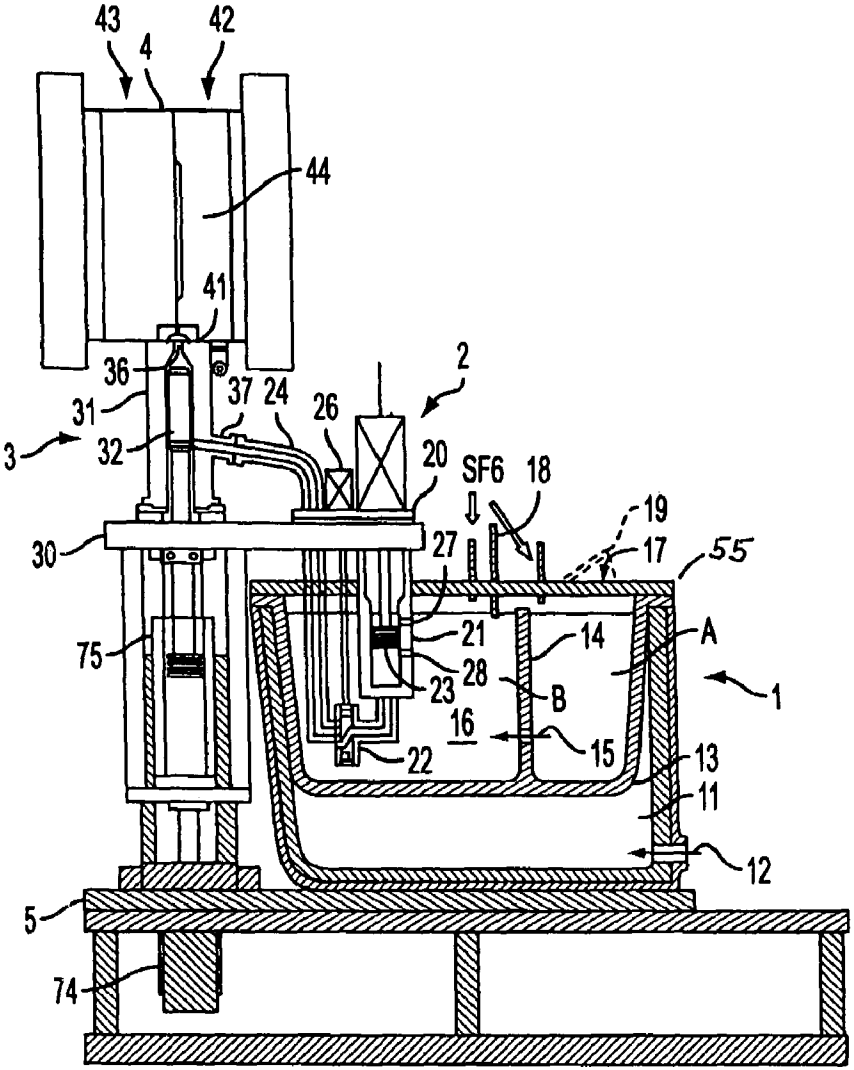
FIG. 1A is a schematic side view of an injection molding apparatus according to one embodiment of the invention.

A die or mold system 4 is located over the injection mechanism 3. In FIGS. 1A and 4A, the die system 4 is horizontally located in which a fixed die 42 and a movable die 43 are secured on each die block. A sprue bushing 41 is fixed on each die as 41*a* and 41*b*. A die or mold cavity 44 is preferably engraved on the fixed die 42 and an ejector plate with knockout pins (not shown) is attached to rear side of the movable die 43. The ejector plate is moved forward and retracted by a hydraulic cylinder (not shown).

Figure 5A:
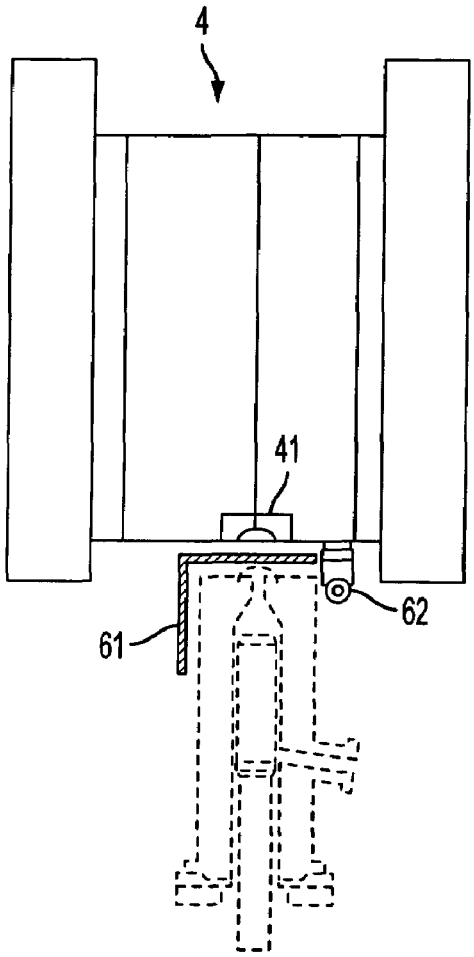
FIGS. 5A, 5B and 5C are schematic views of a shutter mechanism according to one embodiment of the invention including A) side, B) top and C) rear views.
Figure 5B:
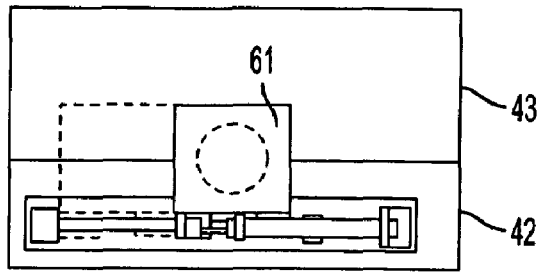
Figure 5C:
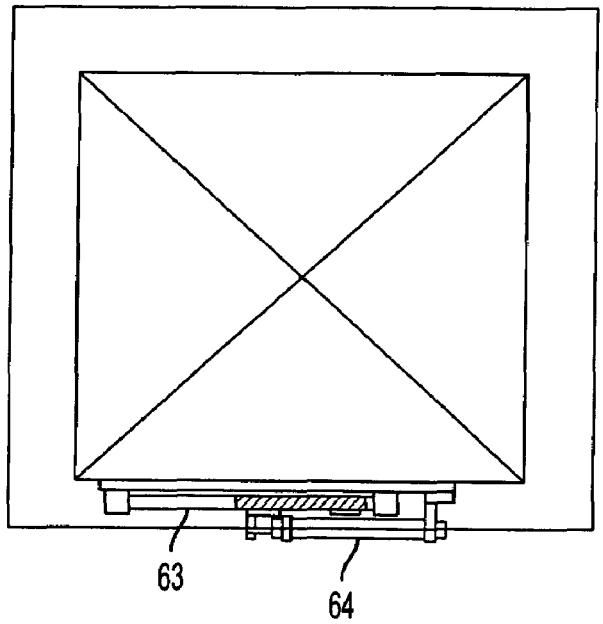

Under the sprue bushing 41, a shutter 6 is attached and secured on the fixed die 42. Details of the shutter 6 are depicted in FIGS. 5A–5C. The shutter 6 includes a shutter plate 61, which has a fitting 62 into which a guide bar 63 is inserted. The shutter plate 61 is actuated by a cylinder 64 connected to the fitting 62. The shutter plate 61 stays back during a stage in which the injection barrel 31 is up and the sprue bushing 41 and the injection nozzle 35 are in contact. When the injection barrel 31 is pulled downward and the nozzle 35 is detached from the sprue bushing 41, the shutter 6 is actuated to slide forward and stops at a position over the nozzle 35. The shutter 6 protects the nozzle 35 from damage by falling solidified metal particles or mist of lubricant sprayed to the dies while the dies are separated and in an open position.

The furnace 1 and the injection mechanism 3 with the casting metal supply system 2 fixed on the base plate 30 are placed on a sliding plate 5 shown in FIG. 1A. As the die height, or thickness of a pair of dies, varies depending on the size of a casting article, the position of the nozzle 35 on the top of the injection barrel 31 is adjusted by sliding the plate 5 in alignment with the receiving sprue bushing 41 on the dies 42, 43.

The operation of the injection molding apparatus of the preferred embodiment is explained stepwise as follows. In the following description, the operation begins when injection of the casting metal is completed.

In the first phase of the casting operation, the dies 42 and 43 are closed and the nozzle 35 is docked with the sprue bushing 41 on the dies 42, 43. The injection plunger 32 is in an upper most position and blocks the opening 33 such that no metal flows between the injection barrel 31 and the metal supply system 2. As soon as the molten metal 16 in the dies (particularly the metal in the gate where the cavity 44 is the thinnest) has had time to solidify (typically a second or less for magnesium alloys), the injection plunger 32 quickly retracts to an intermediate position in the injection barrel 31, sucking molten or semi-solid metal in the sprue 41 and the nozzle opening 36 back into the injection barrel 31. By sucking metal in the nozzle tip back, clogging of the nozzle 35 or formation of a plug is prevented. Further, any semi-solid metal which is sucked back will be remelted in the injection barrel 31. This is significant for the present apparatus as it allows air in the injection barrel 31 to vent from the opening 36.

In order to avoid further cooling of the nozzle 35, immediately after sucking, the injection barrel 31 is actuated downward. The injection plunger 32 continues retracting at a reduced speed compared to the suck back speed until a head of the injection plunger 32 comes just above the opening 33 to conduit 24 on the lower part of the injection barrel 31, such that the opening 33 remains blocked or closed by the injection plunger 32. Alternatively, the injection plunger 32 may remain at the intermediate position in the barrel 31 after performing sucking back the metal, until the plunger 32 is moved down below opening 33 to expose the opening 33 to receive molten metal from the metal supply system 2.

The distance of retraction of the injection barrel 31 is preferably less than 10 mm, for which distance the metal supply system 2 also retracts in the pot 13. It is further preferable that the distance of movement should be less than 5 mm, as solidified metal tends to deposit in the zone where the submerged part of the metal supply system 2 goes up from the level of molten metal 16.

The shutter plate 61 is then actuated and moves to a position over the nozzle 35 to protect the nozzle head from molten metal dripping from the dies. The nozzle temperature begins to rise because the heat conduction has ceased and because the heater 311*a* for the nozzle 35 is on, having sensed the decreased temperature at the thermocouple 312*a* inserted into the nozzle head. The nozzle temperature returns to the set temperature before the next injection cycle begins. The position of the sensing tip of the thermocouple is preferably located to detect the actual nozzle temperature. The sensing tip should be as close to the nozzle opening 36 as possible, as shown in FIG. 4B. This procedure is another advantageous aspect of the present invention.

In the second phase, the casting in the die cavity is cooled and solidifies. The time for solidification is from 1 or less seconds to about 10 seconds depending on the size and thickness of the article being cast. Then, the dies are separated and molded article on the moving die 43 is ejected onto a chute or removed by a robot. The die face is cleaned and lubricant is sprayed on the dies 42, 43.

During this period of time, the supply system 2 is at least partially, and preferably fully submerged in molten casting metal 16 and the molten casting metal 16 is sucked into the metering sleeve 21 by withdrawing the metering plunger 23 up to the full up position. The casting metal 16 comes into the plunger sleeve 21 through the three-way valve 22 communicating with the melting pot as shown in FIG. 3B. The suctioning of the casting metal 16 is completed when the metering plunger 23 passes an opening 28 on upper part of the metering plunger sleeve 21 and, therefore, pressure in the metering sleeve 21 becomes atmospheric pressure. Without opening 28, the present apparatus works, but with the opening it is assured that no air is left in the metering sleeve 21.

Figure 2B:
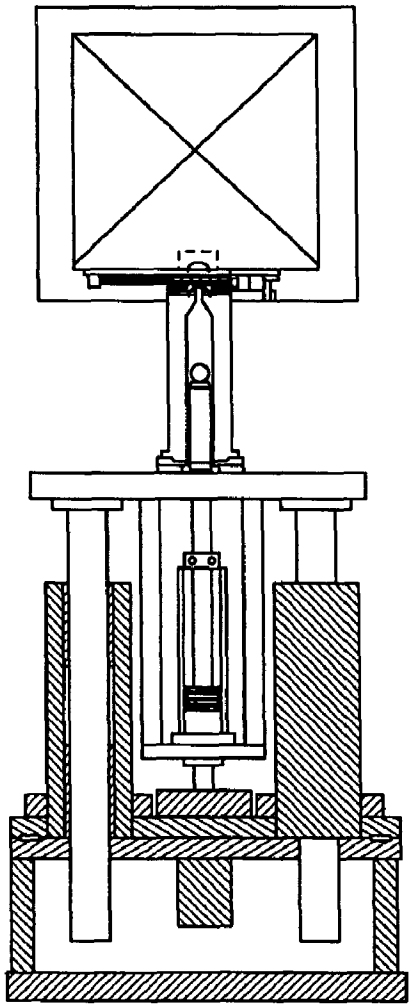
FIG. 2B is a front view of an injection molding apparatus according to one embodiment of the invention illustrating a method of injection molding according to one embodiment of the invention.
Figure 2A:
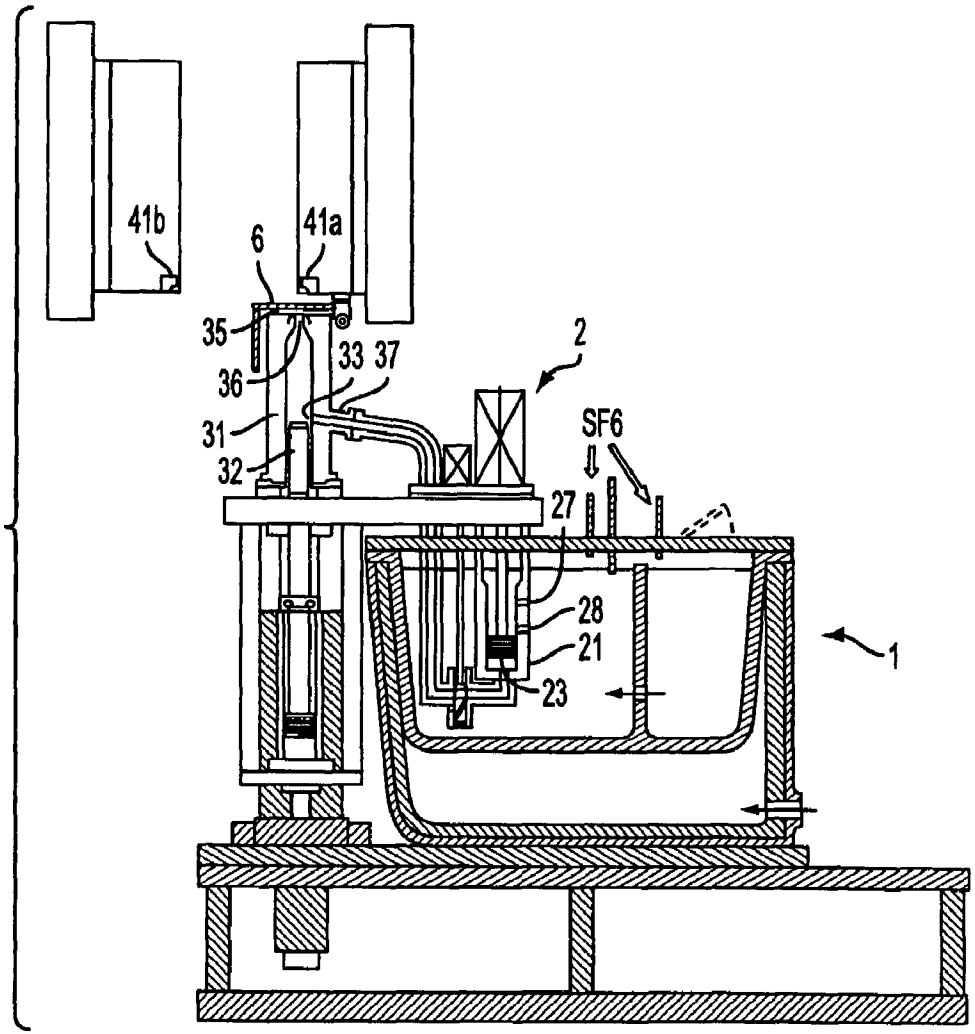
FIG. 2A is a schematic side view of an injection molding apparatus according to one embodiment of the invention illustrating a method of injection molding according to one embodiment of the invention.

Then, the three-way valve 22 closes the passage 39B communicating with the melting pot 13, and connects the sleeve 21 to the conduit 24 via passage 39A, as shown in FIG. 3A. The injection plunger 32 moves downward and opening 33 is opened to receive casting metal 16 from the supply system 2, as shown in FIG. 2A. The casting metal 16 is forced into an injection barrel 31 by pushing down the metering plunger 23 to a desired distance corresponding to a volume required for a shot. The precise metering of casting metal 16 is another advantage of the present apparatus, because it reduces or eliminates burrs around castings caused by an excessive volume of casting metal 16 and pressure in the die cavity 44. Burrs on the casting reduce reproducibility and reliable operation, because burrs unexpectedly stuck to the dies 42, 43 cause troublesome leakage of casting metal 16. The burrs may also cause dents or deformation on the parting face of the dies 42, 43, leading to thicker and larger burrs. Without burrs, machining costs for articles after molding are reduced.

Precise metering is achieved in that the metal supply system 2 of the present apparatus preferably operates without high pressure and without high speed in forcing casting metal 16 into the injection barrel 31. High pressure and high speed are the reasons that a plunger pump in a hot chamber die casting machine is heavy and inaccurate. Immediately after metering of the casting metal 16 is completed, the injection plunger 32 slowly moves upward and stops when the inlet opening 33 is closed off.

In the third phase, the molding dies 42, 43 are engaged and set into a closed position. The shutter 6 moves backward and the injection barrel 31 is pushed upward by a hydraulic cylinder 74 until the nozzle 35 firmly docks onto a sprue bushing 41 on the dies 42 and 43. The metal supply system 2 is at least partially lifted from the melting pot 13 because the system 2 is attached to the injection barrel 31 by plate 30. Then the injection plunger 32 is actuated upward slowly by a hydraulic system 75 to expel the air over the casting metal 16 from the nozzle opening 36 and to vent from an air vent (not shown) engraved on the dies 42, 43 through die cavity 44. The position of the injection plunger 32 at the time the air in the injection barrel 31 is exhausted is predetermined by calculating from the dimensions of the injection barrel 31 and the metered volume of casting metal 16.

Alternatively, the air may be expelled from the injection barrel before the nozzle docks with the sprue bushing 41 in order to reduce the process time for making a molded part. Preferably, the air is expelled from the injection barrel 31 at the same time as another process step is being carried out. For example, the injection plunger 32 may be actuated upward slowly to expel the air over the casting metal 16 from the nozzle opening 36 in the second phase of the process when the dies 42, 43 are in the open position and the molded part is being removed and the dies are being cleaned and lubricated. The distance of upward movement of the injection barrel, the volume of the injection barrel, the amount of metal metered into the injection barrel and the position of the injection barrel and the injection plunger are programmed and controlled by a control system, such as a computer, in order to reduce or prevent metal from overflowing from the nozzle opening 36 while air is being expelled.

In a prior art method, a plug clogging the nozzle is shot out toward die cavity and the compressed air is injected into the die cavity along with casting metal. Not only the plug, but also air caught in the casting metal reduces the cosmetic and physical properties of the article being cast. Thus, the sucking back process described with respect to the first stage above is advantageous because it avoids introducing the plug and air into the cavity 44. At the predetermined position where the air in the injection barrel 31 is exhausted, the speed of the injection plunger 32 is accelerated instantly and the casting metal 16 is injected into the die cavity 44. The injection plunger 32 is then decelerated and stopped. The deceleration of the injection plunger 32 toward the end of injection prevents the injection plunger 32 from bumping against upper end of the injection barrel 31.

Though the volume of casting metal 16 is precisely metered and the temperature thereof is also strictly controlled, the position of the injection plunger 32 at the end of injection may fluctuate due to unexpected factors such as (1) friction increase caused by precipitation of impurities in the molten metal on the surfaces of the injection barrel 32 and/or the plunger or (2) injection pressure loss by leakage through piston rings (not shown). In the present apparatus, the position of the injection plunger 32 is preferably detected or measured by a potentiometer secured on the injection plunger rod. When the injection is completed, the detected injection plunger position is compared with the desired normal position and the difference is transformed through a calculation circuit into a volume of casting metal. Then, the signal is transmitted to the metal supply system 2 as a distance for descending the metering plunger 23 and/or as a distance for descending the injection plunger 32. The downward movement of the plunger 23 precisely meters the amount of the casting metal volume provided into the injection barrel 31.

Another embodiment of the present invention includes a vertical die casting apparatus with a vertical die arrangement. As illustrated in a drawing of FIGS. 6A–C, a furnace 1, a casting metal supply system 2 and a vertical injection mechanism 3 are the same as in the previous embodiment. In this embodiment, a die system 4 is arranged vertically and a sprue bushing 41 is inserted to a stationary lower die 42. An ejector plate with knockout pins is attached to a movable upper die 43 above the stationary lower die 42. The injection barrel 31 moves up and down through an opening 46 on a die block 45 while the diameter of the opening 46 in the die block is larger than the injection barrel 31. A shutter 6 is located behind the dies 42 and 43, and a shuttle tray 7 is located on one side of the dies 42, 43. The locations of the shutter 6 and tray 7 may be reversed if desired. The operation of the apparatus of this embodiment is same as that of the apparatus of the previous embodiment with a horizontal die arrangement in FIGS. 1A and 2A. When the dies are opened, the molded article is separated on the movable die 43 and the shutter 6 and the tray 7 are actuated forward. The shutter 6 protects the nozzle head from the mist of lubricant sprayed. The shuttle tray 7 receives the molded article ejected by the knockout pins and the article is removed from the die area. In this embodiment, the sprue formed is larger than that in the embodiment with horizontally arranged dies.

Another embodiment of the present invention is shown in FIGS. 7A–D, where the injection barrel 31 reaches a sprue bush 41 secured on a die face of the stationary die 42. In this embodiment, the length of the sprue is shortened compared with the embodiment in FIG. 6 and thus, the volume of a formed sprue is reduced.

Figure 6A:
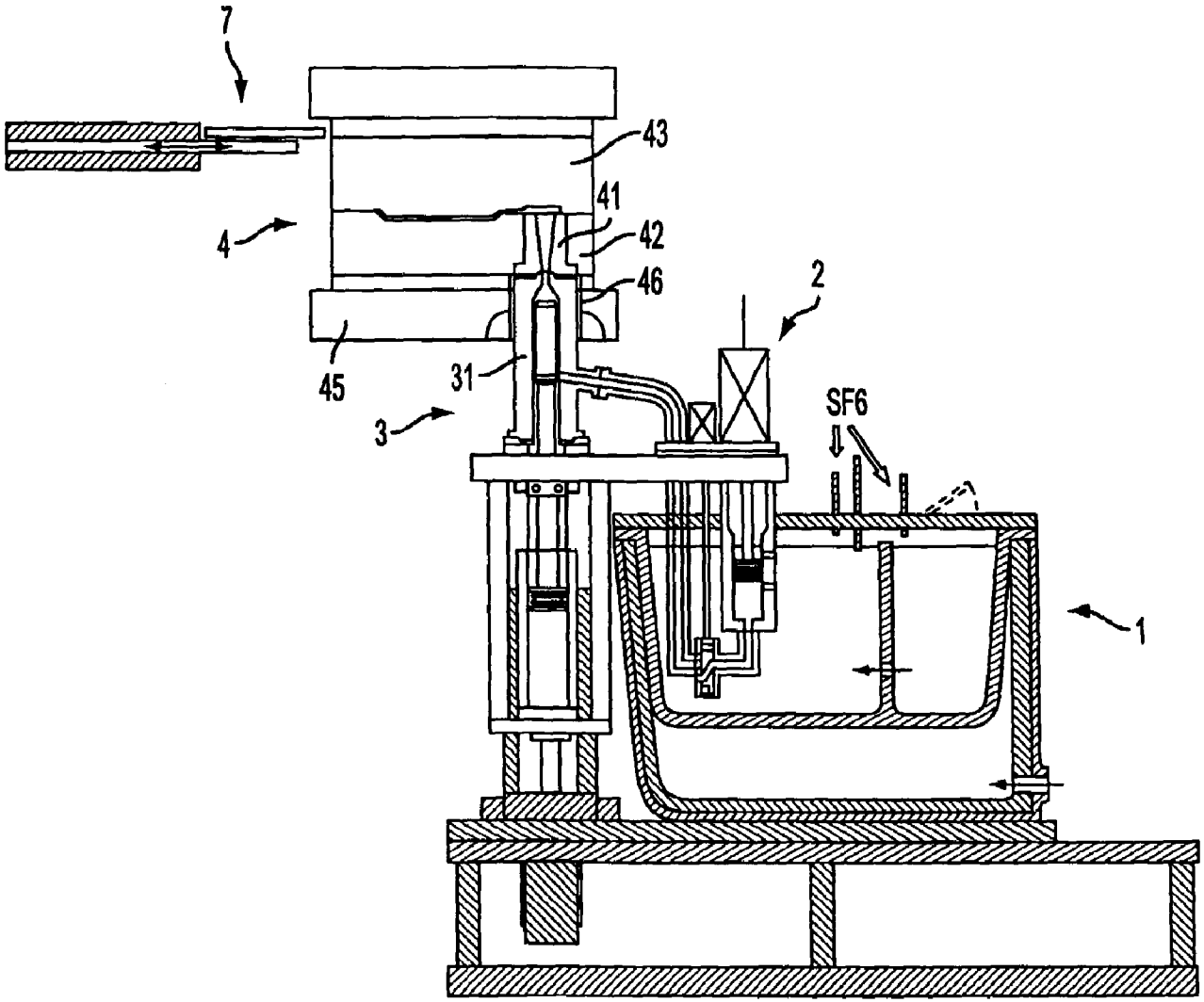
FIGS. 6A, 6B and 6C are schematic views illustrating the method of using the shutter mechanism of FIG. 5A including A) front, B) side and C) detailed side views.
Figure 6C:
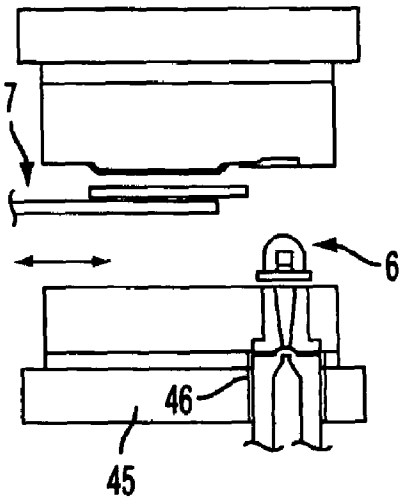
Figure 6B:
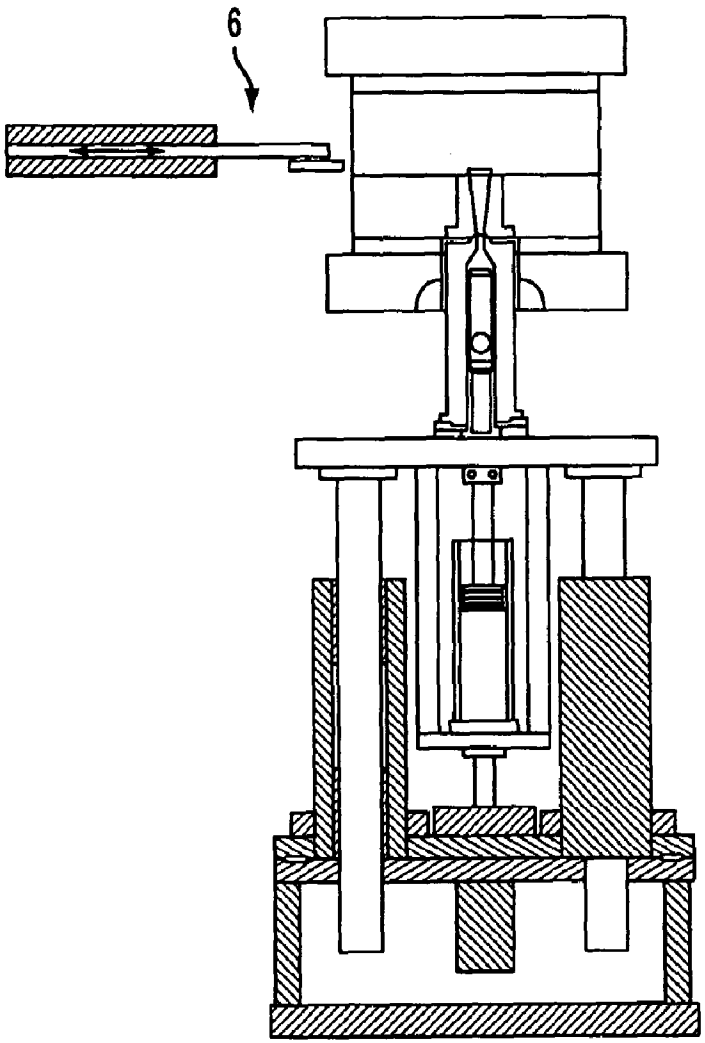
Figure 7C:
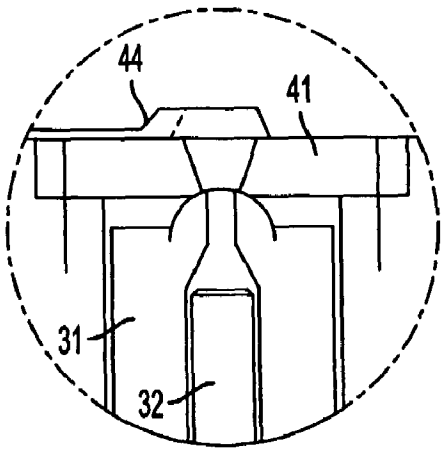
FIGS. 7A, 7B, 7C, and 7D are schematic views of a mold system according to an embodiment of the invention including A) side, B) front, C) side detail, and D) side detail with open mold views.
Figure 7A:
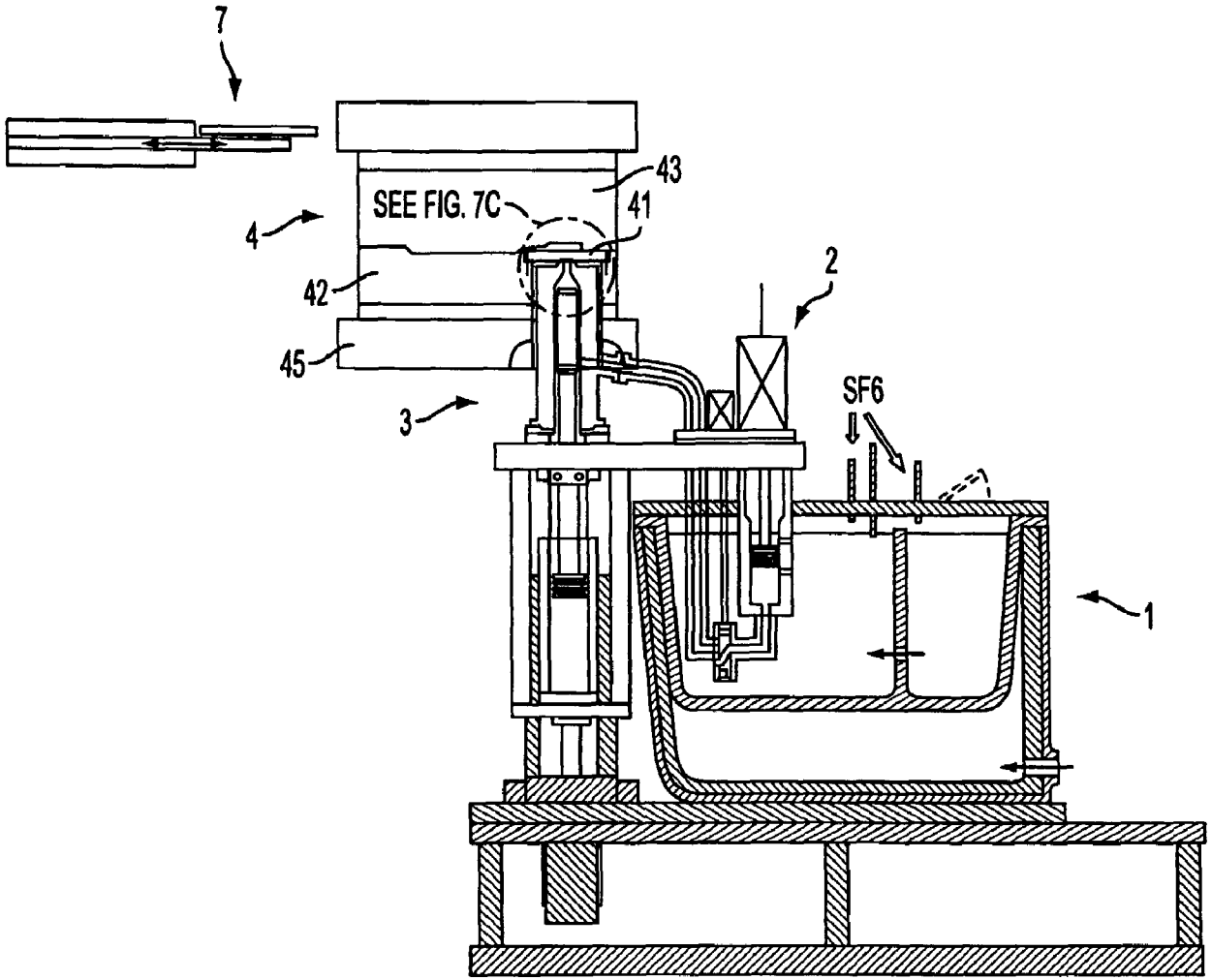
Figure 7D:
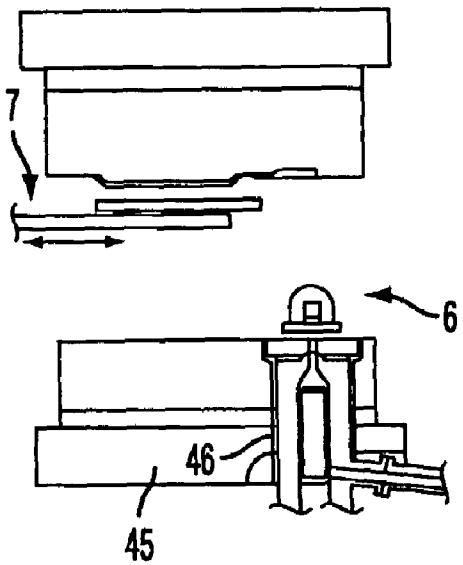
Figure 7B:
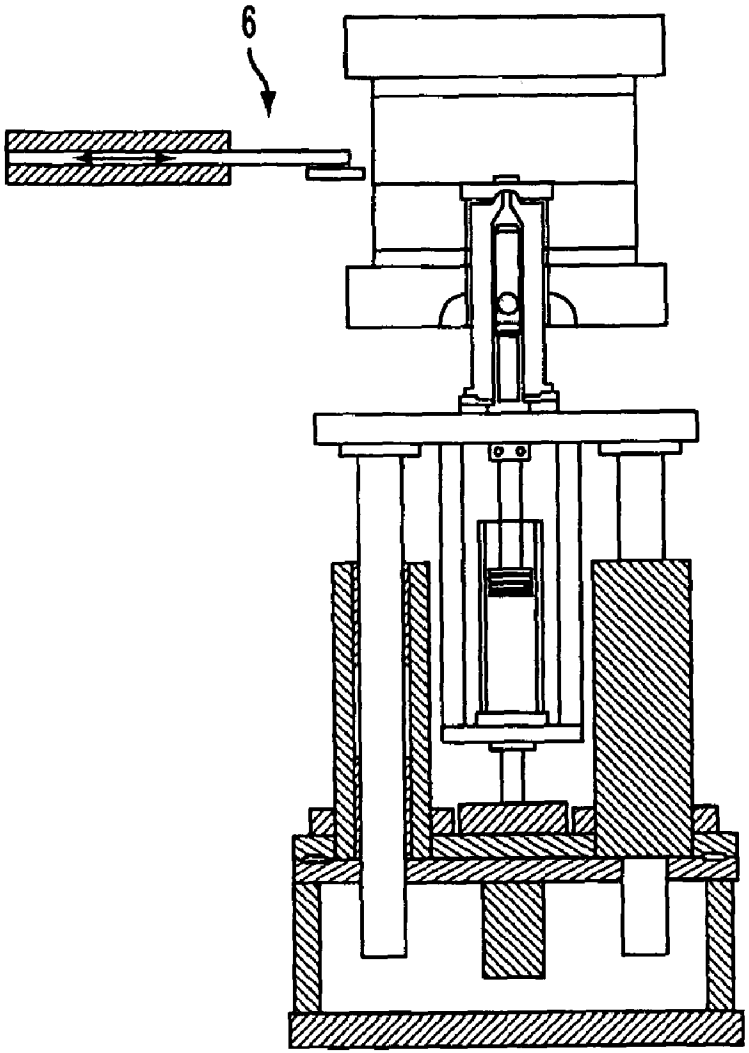

An injection molding method using the vertical die system shown in FIGS. 6A and 7A is a follows. Molten metal is provided into the vertical injection barrel 31 terminating in an injection nozzle 35. The vertical mold system is closed and the vertical injection barrel is raised, such that the injection nozzle 35 contacts the sprue bushing 41 and at least a portion of the injection barrel 31 is located in the opening 46 in the lower die 42. The metal is injected from the injection barrel 31 into the mold cavity. The injection barrel 31 is lowered such that the injection nozzle 35 does not contact the sprue bushing 41. The upper die 43 is raised to open the vertical mold system. The shutter plate 61 is moved between the raised upper die 43 and the lower die 42 to cover the injection nozzle 35, as shown in FIG. 6C. The shuttle tray 7 is provided between the raised upper die 43 and the lower die 42 before or after the shutter plate 61 is moved between the die, as shown in FIGS. 6C and 7D. The knock out pins are extended in the upper die 43 to disengage the molded part from the upper die 43 and to drop the molded part onto the shuttle tray 7. The molded part is removed from the mold cavity by removing the shuttle tray 7 containing the molded part out from between the upper and the lower die (i.e., to the side of the die as shown in FIG. 7A. The mold cavity is cleaned and sprayed with a lubricant after the steps of moving the shutter plate and removing the molded part. Then, the shutter plate 61 is moved away from the injection nozzle and out from between the upper 43 and the lower die 42 (i.e., it is moved behind the die), as shown in FIG. 6B. The dies 42, 43 are closed and are ready for the next injection step.

Figure 8C:
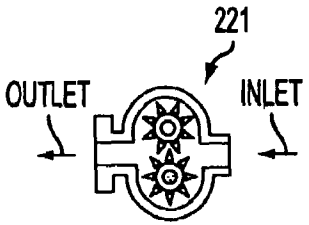
FIGS. 8A, 8B and 8C are schematic views of an embodiment of the invention having a gear pump including A) side, B) front and C) detail views.
Figure 8B:
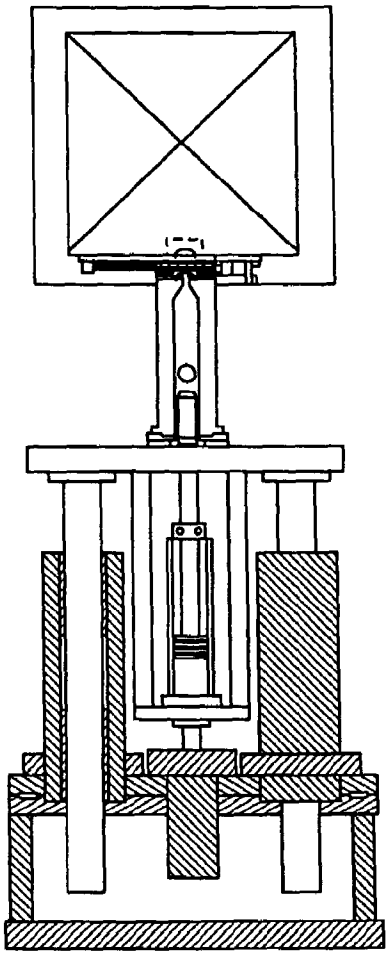
Figure 8A:
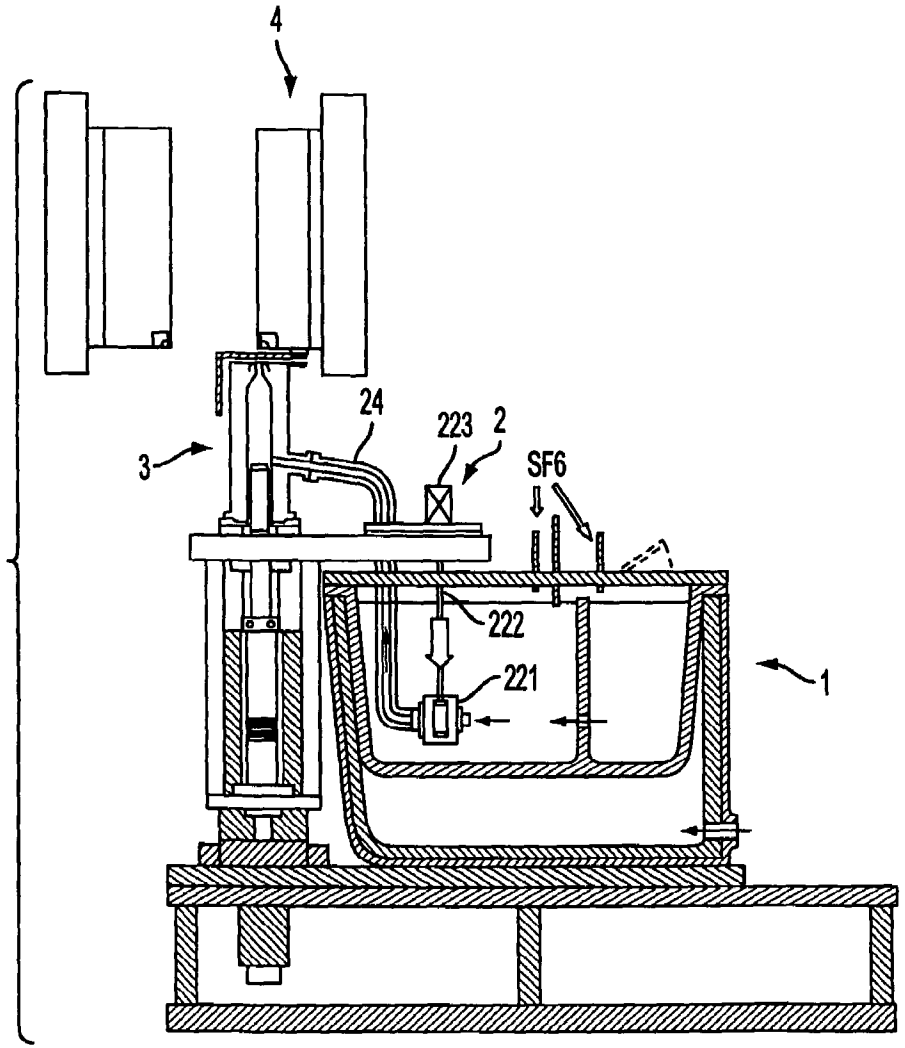

Still another embodiment of the invention is illustrated in FIGS. 8A–8C. In this embodiment, the casting metal supply system 2 comprises a gear pump 221 rather than the plunger pump of the previous embodiments. In addition, this embodiment does not use the three-way valve 22 of the previous embodiments. In a preferred aspect of this embodiment, the gear pump 221 is powered by a motor 223. Power is transferred to the gear pump 221 by use of a motor rod 222. To supply molten metal 16 to the injection barrel 31, the gear pump 221 is turned on. When sufficient casting metal is supplied to the injection barrel 31, the gear pump 221 is simply turned off. Because there is no need to fill a metering sleeve 21 in this embodiment, there is no need for a three-way valve 22.

It should be noted that elements of the apparatus of the above described embodiments may be used interchangeably in any suitable combination. For example, the gear pump 221 of FIG. 8A may be used together with a vertical die arrangement of FIGS. 6A and 7A.

The foregoing description of the invention has been presented for purposes of illustration and description. It is not intended to be exhaustive or to limit the invention to the precise form disclosed, and modifications and variations are possible in light of the above teachings or may be acquired from practice of the invention. The drawings and description were chosen in order to explain the principles of the invention and its practical application. It is intended that the scope of the invention be defined by the claims appended hereto, and their equivalents.

What is claimed is:

1. An injection molding method, comprising:

providing solid metal into a melt furnace;

melting the solid metal into a liquid state in the melt furnace;

providing the liquid metal from the melt furnace through a first metal inlet into a metal supply system located in the melt furnace;

pumping the liquid metal from the metal supply system through a second metal inlet into a vertical injection mechanism; and injecting the liquid metal from the vertical injection mechanism into a mold located above the vertical injection mechanism;

wherein:

the metal supply system comprises a conduit;

a metering plunger located in a sleeve and operatively attached to the conduit pumps the liquid metal;

the liquid metal is provided into the sleeve when the metering plunger retracts to draw in liquid metal into the sleeve by suction from the melt furnace through the first metal inlet;

the liquid metal is provided into the vertical injection mechanism when the metering plunger advances to provide liquid metal from the conduit through the second metal inlet;

the sleeve contains a first opening to the melt furnace located between a maximum retracted and a maximum advanced position of the metering plunger;

the metering plunger is retracted above the first opening to draw in liquid metal into the sleeve; and the metering plunger is advanced below the first opening to provide liquid metal through the second metal inlet;

further comprising:

vertically moving a three way valve located across the conduit to a first position to allow liquid metal to flow from the melt furnace into the sleeve;

vertically moving the three way valve to a second position to allow liquid metal to flow from the metering plunger toward the second metal inlet after the step of retracting the metering plunger above the opening; and vertically moving the three way valve to a third position to allow liquid metal to flow from the vertical injection mechanism to a drain.

2. The method of claim 1, further comprising lifting the vertical injection mechanism and the metal supply system together towards the mold prior to the step of injecting.

* * * * *